US008292596B2

(12) United States Patent
Ota et al.

(10) Patent No.: US 8,292,596 B2
(45) Date of Patent: Oct. 23, 2012

(54) VARIABLE DISPLACEMENT TYPE COMPRESSOR WITH DISPLACEMENT CONTROL MECHANISM

(75) Inventors: Masaki Ota, Kariya (JP); Masahiro Kawaguchi, Kariya (JP); Hideharu Yamashita, Kariya (JP); Hiroshi Kubo, Kariya (JP); Ryo Matsubara, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 411 days.

(21) Appl. No.: 12/429,439

(22) Filed: Apr. 24, 2009

(65) Prior Publication Data

US 2009/0269216 A1 Oct. 29, 2009

(30) Foreign Application Priority Data

Apr. 28, 2008 (JP) ..... P2008-117385

(51) Int. Cl.
*F04B 1/26* (2006.01)

(52) U.S. Cl. ..... 417/222.1; 417/222.2

(58) Field of Classification Search ..... 417/222.1–222.2
See application file for complete search history.

(56) References Cited

U.S. PATENT DOCUMENTS

| | | | | |
|---|---|---|---|---|
| 4,723,891 | A | 2/1988 | Takenaka et al. | |
| 6,733,246 | B2 | 5/2004 | Imai et al. | |
| 2001/0055532 | A1 * | 12/2001 | Ota et al. | 417/222.2 |
| 2002/0006337 | A1 * | 1/2002 | Kimura et al. | 417/222.2 |
| 2004/0120829 | A1 * | 6/2004 | Pitla et al. | 417/222.2 |

(Continued)

FOREIGN PATENT DOCUMENTS

EP 1172559 A2 1/2002

(Continued)

OTHER PUBLICATIONS

European Search Report for application No. 09158796.4-2315 dated Aug. 27, 2009.

(Continued)

*Primary Examiner* — Karabi Guharay
*Assistant Examiner* — Michael Santonocito
(74) *Attorney, Agent, or Firm* — Locke Lord LLP

(57) ABSTRACT

A variable displacement type compressor in which a discharge-pressure region, a suction-pressure region and a pressure control chamber are defined, has a tiltable swash plate and a piston reciprocated by the swash plate in the pressure control chamber. The inclination angle of the swash plate and the piston stroke are changed by adjustment of pressure in the pressure control chamber thereby to control the displacement of the compressor. The compressor further comprises a supply passage for supplying refrigerant gas from the discharge-pressure region to the pressure control chamber, a release passage for releasing the refrigerant gas from the pressure control chamber to the suction-pressure region, a first control valve for adjusting a cross-sectional area of the supply passage from the discharge-pressure region to the pressure control chamber and a second control valve for adjusting cross-sectional area of the release passage. The second control valve includes a valve body for opening and closing the release passage whose cross-sectional area is set minimum when the valve body is located at the closed position and a valve spring for urging the valve body in a direction to open the release passage. When the second control valve is closed, pressure in the supply passage downstream the first control valve acts on the valve body in a direction to close the release passage and pressure in the suction-pressure region acts on the valve body in a direction to open the release passage.

6 Claims, 4 Drawing Sheets

U.S. PATENT DOCUMENTS

| | | | | |
|---|---|---|---|---|
| 2004/0258536 | A1* | 12/2004 | Ota et al. | 417/222.2 |
| 2005/0008499 | A1* | 1/2005 | Umemura et al. | 417/222.2 |
| 2006/0080983 | A1* | 4/2006 | Ota et al. | 62/208 |

FOREIGN PATENT DOCUMENTS

| | | | |
|---|---|---|---|
| EP | 1 336 757 | A2 | 8/2003 |
| EP | 1 489 304 | A1 | 12/2004 |
| EP | 1586772 | A1 | 10/2005 |
| JP | 4-134188 | A | 5/1992 |
| JP | 2002-021721 | A | 1/2002 |
| JP | 2003-239857 | A | 8/2003 |
| JP | 2005-009422 | A | 1/2005 |

OTHER PUBLICATIONS

Office Action in counterpart Japanese Application No. 2008-117385 dated Jan. 31, 2012.

* cited by examiner

VARIABLE DISPLACEMENT TYPE COMPRESSOR WITH DISPLACEMENT CONTROL MECHANISM

BACKGROUND OF THE INVENTION

The present invention relates to a displacement control mechanism for a variable displacement type compressor which adjusts the pressure in a pressure control chamber by supplying refrigerant gas in a discharge-pressure region into the pressure control chamber and releasing the refrigerant gas in the pressure control chamber to a suction-pressure region, thereby controlling the displacement of the compressor.

In a variable displacement type compressor provided with a pressure control chamber having therein a swash plate whose inclination angle is variable, the inclination angle of the swash plate decreases with an increase of the pressure in the pressure control chamber. On the other hand, the inclination angle of the swash plate increases with a decrease of the pressure in the pressure control chamber. When the inclination angle of the swash plate decreases, the stroke of a piston decreases thereby to decrease the displacement of the compressor. When the inclination angle of the swash plate increases, the stroke of the piston increases thereby to increase the displacement of the compressor.

Since the refrigerant gas which is supplied to the pressure control chamber has been already compressed, the operating efficiency of the variable displacement type compressor deteriorates as the amount of refrigerant gas released from the pressure control chamber to a suction-pressure region of the compressor increases. Therefore, the cross-sectional area of a release passage through which the refrigerant gas is released from the pressure control chamber to the suction-pressure region should be small as much as possible in view of the operating efficiency.

If the compressor is left in a stopped state for a long time, the refrigerant gas is changed into a liquid state and the liquefied refrigerant is accumulated in the pressure control chamber. When the compressor is started in such a state, the liquefied refrigerant is not released rapidly to the suction-pressure region if the release passage has a fixed throttle with a small cross-sectional area. As a result, the liquefied refrigerant is vaporized in the pressure control chamber and the pressure in the pressure control chamber is increased excessively. Therefore, it takes a long time before the displacement of the compressor is increased to a desired level after the compressor is started A variable displacement type compressor with a displacement control mechanism is disclosed in Japanese Patent Application Publication NO. 2002-21721 to solve the above problem. The displacement control mechanism in this Publication has a first control valve which adjusts the cross-sectional area of a refrigerant gas supply passage through which refrigerant gas is supplied from a discharge-pressure region of the compressor to the pressure control chamber and a second control valve which adjusts a cross-sectional area of a refrigerant gas release passage through which refrigerant gas is released from the pressure control chamber to a suction-pressure region of the compressor The first control valve is an electromagnetic control valve which is operable to adjust the opening degree of the valve by changing the electromagnetic force. When the first control valve is in deenergized state, the opening degree of the valve is maximum and the inclination angle of a swash plate is minimum. This state corresponds to the minimum displacement operation of the compressor in which the displacement thereof is fixed at minimum. When the first control valve is in energized state, the opening degree of the valve becomes smaller than the maximum and then the inclination angle of the swash plate becomes larger than the minimum. This state corresponds to an intermediate displacement operation in which the displacement is not fixed to the minimum.

The second control valve has a spool (a valve body for adjusting the cross-sectional area of the release passage) defining a cylindrical space and a back pressure chamber in the spool chamber in which the spool is accommodated. The back pressure chamber communicates with a pressure region downstream of the first control valve and the cylindrical space communicates with the pressure control chamber through a release passage (bleed passage). The spool is urged toward the back pressure chamber by a spring. A bleed hole is formed in the spool so as to secure a minimum cross-sectional area of the release passage. When the variable displacement type compressor is started, the first control valve is closed and the spool of the second control valve is moved in direction which increases the cross-sectional area of the release passage. Thus, the liquefied refrigerant in the pressure control chamber is rapidly released to the suction-pressure region, thereby reducing the time before the displacement is increased to a desired level after the variable displacement type compressor is started When the first control valve is in energized state and opened, the second control valve is closed (or its spool is seated against a valve seat) and the refrigerant gas is released from the pressure control chamber to the suction-pressure region only through the bleed hole. In this state, the compressor is operating under a displacement more than the minimum (i.e. intermediate displacement).

When the cross-sectional area of the bleed hole is adjusted to be small, the pressure in the cylindrical space when the second control valve is in the closed state becomes substantially the same as that in the pressure control chamber. Since the first control valve has a throttling function, the pressure in the back pressure chamber becomes a pressure corresponding to the pressure in the pressure control chamber that is slightly higher than that in the cylindrical space.

Since the refrigerant gas released from the pressure control chamber to the suction chamber needs to be stopped during compressor operation under the minimum displacement, the second control valve should be in the closed state (or the spool be seated against the valve seat). Furthermore, the pressure in the back pressure chamber is slightly higher than that in the cylindrical space. Accordingly, the spring force of the spool spring needs to be small so that the spool is seated against the valve seat by the differential pressure between the back pressure chamber and the cylindrical space during the compressor operation under the minimum displacement.

When the first control valve is changed from the opened state to the closed state, the spool is moved away the valve seat. If the spring force of the spool spring is too small, however, the spool movement may be hampered by any foreign matters present between the peripheral surface of the spool and its accommodation chamber This prevents the liquefied refrigerant in the pressure control chamber from being rapidly released when the compressor is started.

If the cross-sectional area of the bleed hole is made too large, an excessive amount of refrigerant gas is released from the pressure control chamber to the suction chamber, with the result that the operating efficiency is deteriorated. Therefore, the present invention is directed to providing a variable displacement type compressor with a displacement control mechanism according to which the time taken before the displacement of the compressor is increased to the desired level after a start-up of the compressor is reduced and also the operating efficiency of the compressor is improved.

SUMMARY OF THE INVENTION

A variable displacement type compressor in which a discharge-pressure region, a suction-pressure region and a pressure control chamber are defined, has a tiltable swash plate and a piston reciprocated by the swash plate in the pressure control chamber. The inclination angle of the swash plate and the piston stroke are changed by adjustment of pressure in the pressure control chamber thereby to control the displacement of the compressor The compressor further comprises a supply passage for supplying refrigerant gas from the discharge-pressure region to the pressure control chamber, a release passage for releasing the refrigerant gas from the pressure control chamber to the suction-pressure region, a first control valve for adjusting a cross-sectional area of the supply passage from the discharge-pressure region to the pressure control chamber and a second control valve for adjusting cross-sectional area of the release passage. The second control valve includes a valve body for opening and closing the release passage whose cross-sectional area is set minimum when the valve body is located at the closed position and a valve spring for urging the valve body in a direction to open the release passage. When the second control valve is closed, pressure in the supply passage downstream the first control valve acts on the valve body in a direction to close the release passage and pressure in the suction-pressure region acts on the valve body in a direction to open the release passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
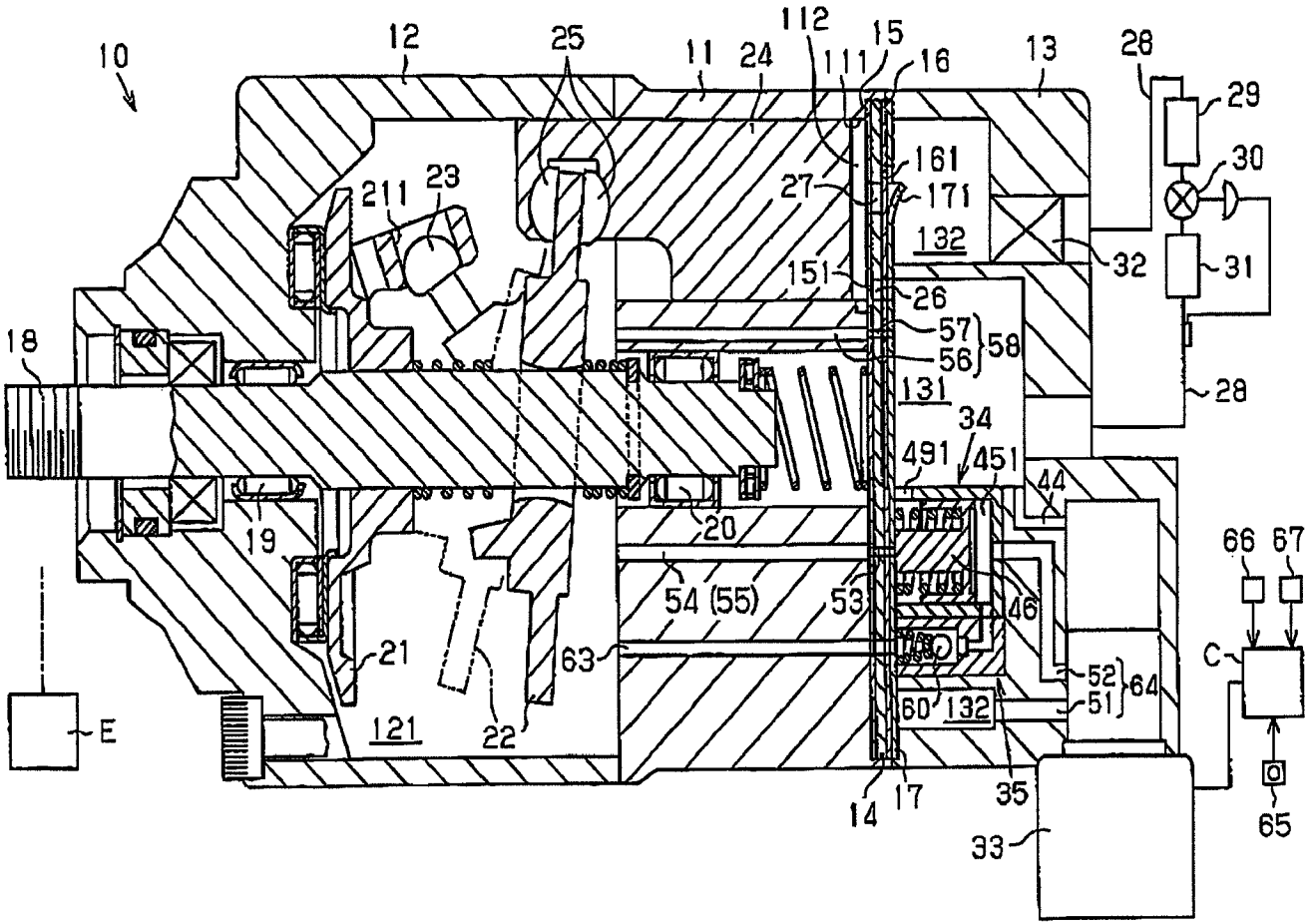
FIG. 1 is a longitudinal cross-sectional view of a clutchless variable displacement type compressor according to a first preferred embodiment of the present invention.

The first preferred embodiment of a clutchless variable displacement type compressor according to the present invention will now be described with reference to FIGS. 1 through 3. The compressor is generally designated by numeral 10. The left side and the right side of the compressor 10 as viewed in FIG. 1 correspond to the front side and the rear side thereof. As shown in FIG. 1, the compressor 10 includes a cylinder block 11 and a front housing 12 connected to the front end of the cylinder block 11. A rear housing 13 is connected to the rear end of the cylinder block 11 through a valve plate 14, valve forming plates 15, 16 and a retainer forming plate 17. The cylinder block 11, the front housing 12 and the rear housing 13 cooperate to form the entire housing of the variable displacement type compressor 10.

The front housing 12 and the cylinder block 11 define therebetween a pressure control chamber 121. A rotary shaft 18 is rotatably supported by the front housing 12 and the cylinder block 11 through radial bearings 19, 20. Part of the rotary shaft 18 extending out of the pressure control chamber 121 is connected to an external drive source E (not shown), e.g. a vehicle engine, and receives a rotational drive force therefrom.

A lug plate 21 is secured to the rotary shaft 18. A swash plate 22 is supported by the rotary shaft 18 in facing relation to the lug plate 21 so as to be slidable in and inclinable relative to the axial direction of the rotary shaft 18.

The lug plate 21 has formed therethrough a pair of guide holes 211. A pair of guide pins 23 are provided on the swash plate 22 and slidably fitted in the paired guide holes 211, respectively. The guide holes 211 and the guide pins 23 cooperate to allow the swash plate 22 to incline relative to the axis of the rotary shaft 18 and rotate with the rotary shaft 18. The inclination of the swash plate 22 is guided by the guide pins 23 slidably fitted in the guide holes 211 and the rotary shaft 18 slidably supporting the swash plate 23.

As the center of the swash plate 22 moves toward the lug plate 21, the inclination angle of the swash plate 22 increases. The maximum inclination angle of the swash plate 22 is restricted by the contact between the swash plate 22 and the lug plate 21. The swash plate 22 shown by solid line in FIG. 1 is positioned at the minimum inclination angle. The swash plate 22 shown by chain double-dashed line in FIG. 1 is positioned at the maximum inclination angle. The minimum inclination angle of the swash plate 22 is set slightly larger than 0°.

The cylinder block 11 has formed therethrough a plurality of cylinder bores 111 and a piston 24 is slidably received in each cylinder bore 111. Rotation of the swash plate 22 is converted to reciprocation of each piston 24 in its cylinder bore 111 through a pair of shoes 25.

The rear housing 13 has formed therein a suction chamber 131 as a suction-pressure region and a discharge chamber 132 as a discharge-pressure region. The valve plate 14, the valve forming plate 16 and the retainer forming plate 17 have formed therethrough a suction port 26. Similarly, the valve plate 14 and the valve forming plate 15 have formed therethrough a discharge port 27. The valve forming plate 15 has formed therein a suction valve 151 and the valve forming plate 16 has formed therein a discharge valve 161, respectively. The cylinder bore 111, the valve forming plate 15 and the piston 24 cooperate to define a compression chamber 112 in the cylinder block 11.

Refrigerant gas in the suction chamber 131 is drawn into the compression chamber 112 through the suction port 26 while pushing open the suction valve 151 as the piston 24 moves toward the bottom dead center or leftward in FIG. 1. The refrigerant gas flowed into the compression chamber 112 is compressed and then discharged into the discharge chamber 132 through the discharge port 27 while pushing open the discharge valve 161 as the piston 24 moves toward the top dead center or rightward in FIG. 1. The discharge valve 161 is brought into contact with a retainer 171 of the retainer forming plate 17, thus the opening degree of the discharge valve 161 being restricted.

When the pressure in the pressure control chamber 121 is decreased, the inclination angle of the swash plate 22 is increased and the displacement of the variable displacement type compressor is Increased, accordingly. On the other hand, the inclination angle of the swash plate 22 is decreased with an increase of the pressure in the pressure control chamber 121 and the displacement of the variable displacement type compressor is decreased, accordingly. The suction chamber 131 is connected with the discharge chamber 132 through an external refrigerant circuit 28. The external refrigerant circuit 28 includes a condenser 29 for removing heat from the compressed refrigerant gas, an expansion valve 30 and an evaporator 31 for transferring ambient heat to the refrigerant. The expansion valve 30 is a temperature-sensitive valve operable to control the flow rate of refrigerant in accordance with the temperature of the refrigerant at the outlet of the evaporator 31. A stop device is provided between the discharge chamber 132 and the external refrigerant circuit 28. When the stop device is opened, the refrigerant gas in the discharge chamber 132 flows out to the external refrigerant circuit 28 and returns to the suction chamber 131.

Figure 2:
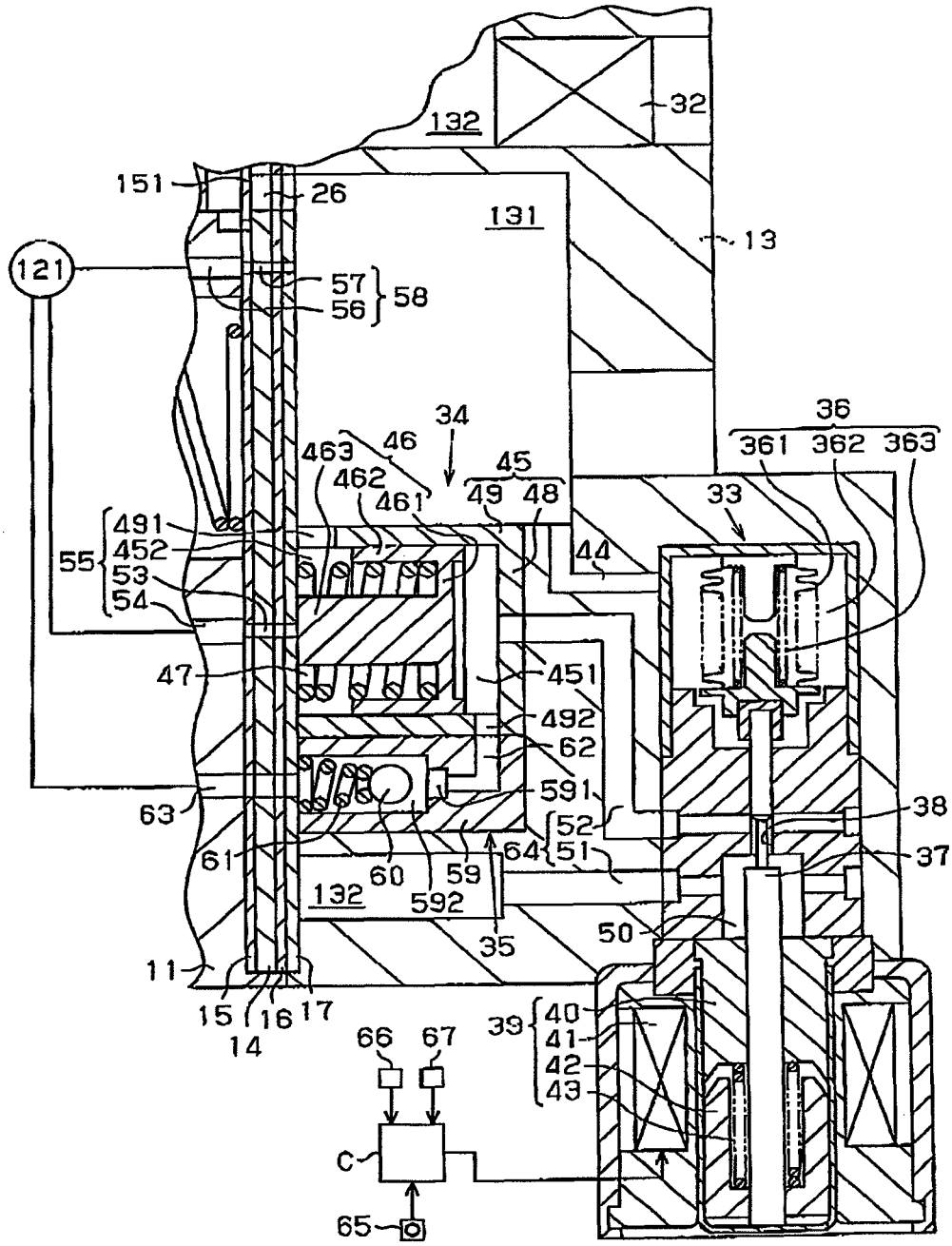
FIG. 2 is an enlarged fragmentary longitudinal cross-sectional view of the variable displacement type compressor of FIG. 1.

As shown in FIG. 2, an electromagnetic first control valve 33, a second control valve 34 and a check valve 35 are disposed in the rear housing 13. The first control valve 33 has a solenoid 39 having a fixed core 40 which is energized by an electric current supplied to a coil 41 of the solenoid 39 thereby to attract a movable core 42 toward the fixed core 40. The electromagnetic force of the solenoid 39 urges a valve body 37 in the direction to close a valve hole 38 against the spring force of a spring 43. Supply of electric current to the solenoid 39 is controlled by a controller C (duty-ratio controlling being performed in this preferred embodiment).

The first control valve 33 includes a pressure sensing device 36 having therein a bellows 361, a pressure sensing chamber 362 and a spring 363. The pressure in the suction chamber 131 (or suction pressure) is applied to the bellows 361 through a suction pressure passage 44 and the pressure sensing chamber 362. The valve body 37 is connected to the bellows 361. The pressure in the bellows 361 and the spring force of the spring 363 urge the valve body 37 in the direction which causes the valve hole 38 to be opened A valve chamber 50 is formed in the first control valve 33 in communication with the valve hole 38 and also with the discharge chamber 132 through a first supply passage 51.

The second control valve 34 includes a valve housing 45 having therein a valve body 46 and a valve spring 47 urging the valve body 46. The valve housing 45 includes a disc-shaped end wall 48 and a peripheral wall 49 integrally formed with the end wall 48. The end of the peripheral wall 49 located remote from the end wall 48 is connected to the retainer forming plate 17.

The valve body 46 includes a disc-shaped base portion 461, a cylindrical sliding portion 462 integrally formed with the base portion 461 at the peripheral portion thereof and a pillar-shaped contact portion 463 integrally formed with the base portion 461 and extending from the center of the base portion 461 towards the retainer forming plate 17. The valve body 46 is fitted in the valve housing 45 so that the sliding portion 462 is in sliding contact with the inner peripheral wall 49 of the valve housing 45. The interior of the valve housing 45 is divided by the valve body 46 into a back pressure chamber 451 and a second control valve chamber 452. The contact portion 463 of the valve body 46 is contactable at the distal end surface thereof with the retainer forming plate 17. The end surface of the sliding portion 462 adjacent to the base portion 461 thereof is contactable with the end wall 48 of the valve housing 45. The valve spring 47 is interposed between the retainer forming plate 17 and the base portion 461. The valve spring urges the valve body 46 towards the back pressure chamber 451.

The back pressure chamber 451 communicates with the valve hole 38 of the first control valve 33 through a second supply passage 52. The peripheral wall 49 of the valve housing 45 has formed therethrough a communication hole 492 which is opened and closed by the sliding portion 462 of the valve body 46.

The second control valve chamber 452 communicates with the pressure control chamber 121 through a second throttle passage 53 formed through the retainer forming plate 17, the valve plate 14 and the valve forming plate 15, 16 and through a second bleed passage 54 formed through the cylinder block 11. The second control valve chamber 452 communicates also with the suction chamber 131 through a bleed hole 491 formed through the peripheral wall 49 of the valve housing 45. When the contact portion 463 of the valve body 46 is in contact with the retainer forming plate 17 as a valve seat defining the second control valve chamber 452, the second throttle passage 53 is closed thereby to block the fluid communication between the pressure control chamber 121 and the second control valve chamber 452.

The second bleed passage 54, the second throttle passage 53, the second control valve chamber 452 and the bleed hole 491 cooperate to form a second release passage 55 between the pressure control chamber 121 and the suction chamber 131.

As shown in FIG. 1, the pressure control chamber 121 communicates with the suction chamber 131 through a first bleed passage 56 formed through the cylinder block 11 and a first throttle passage 57 formed through the retainer forming plate 17, the valve plate 14 and valve forming plates 15, 16. The first bleed passage 56 and the first throttle passage 57 serve as the first release passage 58 providing constant refrigerant gas communication between the pressure control chamber 121 and the suction chamber 131. The second release passage 55 and the first release passage 58 are arranged in parallel relation to each other.

As shown in FIG. 2, the check valve 35 includes a check valve housing 59 having therein a check valve body 60 and a check valve spring 61 urging the check valve body 60 in the direction to close a check valve hole 591 formed in the housing 59. The check valve hole 591 communicates with the communication hole 492 of the second control valve 34 through a third supply passage 62. When the second throttle passage 53 is closed by the valve body 46 of the second control valve 34, the communication hole 492 is opened by the sliding portion 462 of the valve body 46, thus allowing the communication between the back pressure chamber 451 and the check valve hole 591. A check valve chamber 592 is formed in the check valve 35 which communicates with the pressure control chamber 121 through a fourth supply passage 63 formed through the retainer forming plate 17, the valve plate 14, valve forming plates 15,16 and the cylinder block 11.

The first supply passage 51, the second supply passage 52 and the fourth supply passage 63 form a part of a supply passage 64 for supplying refrigerant gas from the discharge chamber 132 to the pressure control chamber 121. The controller C operable to control the operation of the solenoid 39 of the first control valve 33 (by duty ratio) supplies electric current to the solenoid 39 when the air conditioning switch 65 is turned on and stops supplying the electric current when the air conditioning switch 65 is turned off. The controller C is electrically connected to a room temperature setting device 66 and a room temperature detector 67. With the air conditioning switch 65 turned on the controller C controls the electric current supplied to the solenoid 39 based on the temperature difference between a target temperature set by the room temperature setting device 66 and the actual temperature detected by the room temperature detector 67.

The opening and closing of the valve hole 38 of the first control valve 33, i.e. the degree of valve opening in the first control valve 33, depends on the balance among various forces such as the electromagnetic force generated by the solenoid 39, the spring force of the spring 43 and the urging force of the pressure sensing device 36. The degree of valve opening in the first control valve 33 can be continuously adjusted by changing the electromagnetic force. Specifically, as the electromagnetic force increases, the degree of valve opening in the first control valve 33 decreases. Furthermore, as the suction pressure in the suction chamber 131 increases, the degree of valve opening in the first control valve 33 decreases. Thus the first control valve 33 is operable to adjust the cross-sectional area of the supply passage from the discharge-pressure region to the pressure control chamber 121. On the other hand, as the suction pressure in the suction chamber 131 decreases, the degree of valve opening in the first control valve 33 increases. The first control valve 33 controls suction pressure to a set pressure in accordance with the electromagnetic force.

FIG. 2 shows the state of the compressor in which with the air conditioning switch 65 turned off, supplying of electric current to the solenoid 39 is stopped (duty ratio=0), so that the degree of valve opening in the first control chamber 33 is the maximum. In this state, the inclination angle of the swash plate 22 is the minimum that is slightly larger than 0° and, therefore, refrigerant gas is being discharged from the cylinder bore 111 to the discharge chamber 132. It is so arranged that the stop device 32 is closed thereby to stop the circulation of refrigerant in the external refrigerant circuit 28 when the swash plate 22 is at the minimum inclination angle. Part of the refrigerant gas discharged from the cylinder bore 111 to the discharge chamber 132 flows into the back pressure chamber 451 in the second control valve 34 through the valve hole 38 in the first control valve 33. The valve body 46 of the second control valve 34 is moved by the pressure in the back pressure chamber 451 so as to close the second throttle passage 53.

Refrigerant gas in the back pressure chamber 451 flows into the check valve chamber 592 through the communication hole 492, the third supply passage 62 and the check valve hole 591 of the check valve 35 while pushing open the check valve body 60. Thus the refrigerant gas flows into the pressure control chamber 121 through the fourth supply passage 63. In other words, part of the refrigerant gas in the discharge chamber 132 flows into the pressure control chamber 121 through the supply passage 64. Refrigerant gas in the pressure control chamber 121 flows out thereof through the first release passage 58 and is drawn into the suction chamber 131 and then into the cylinder bore 111 to be compressed. Refrigerant gas compressed is discharged into the discharge chamber 132.

The inclination angle of the swash plate 22 is minimum in the state of FIG. 2 and the variable displacement type compressor 10 operates under the minimum displacement. In this state, since the stop device 32 is closed, no circulation of refrigerant gas occurs in the external refrigerant circuit 28.

Figure 3:
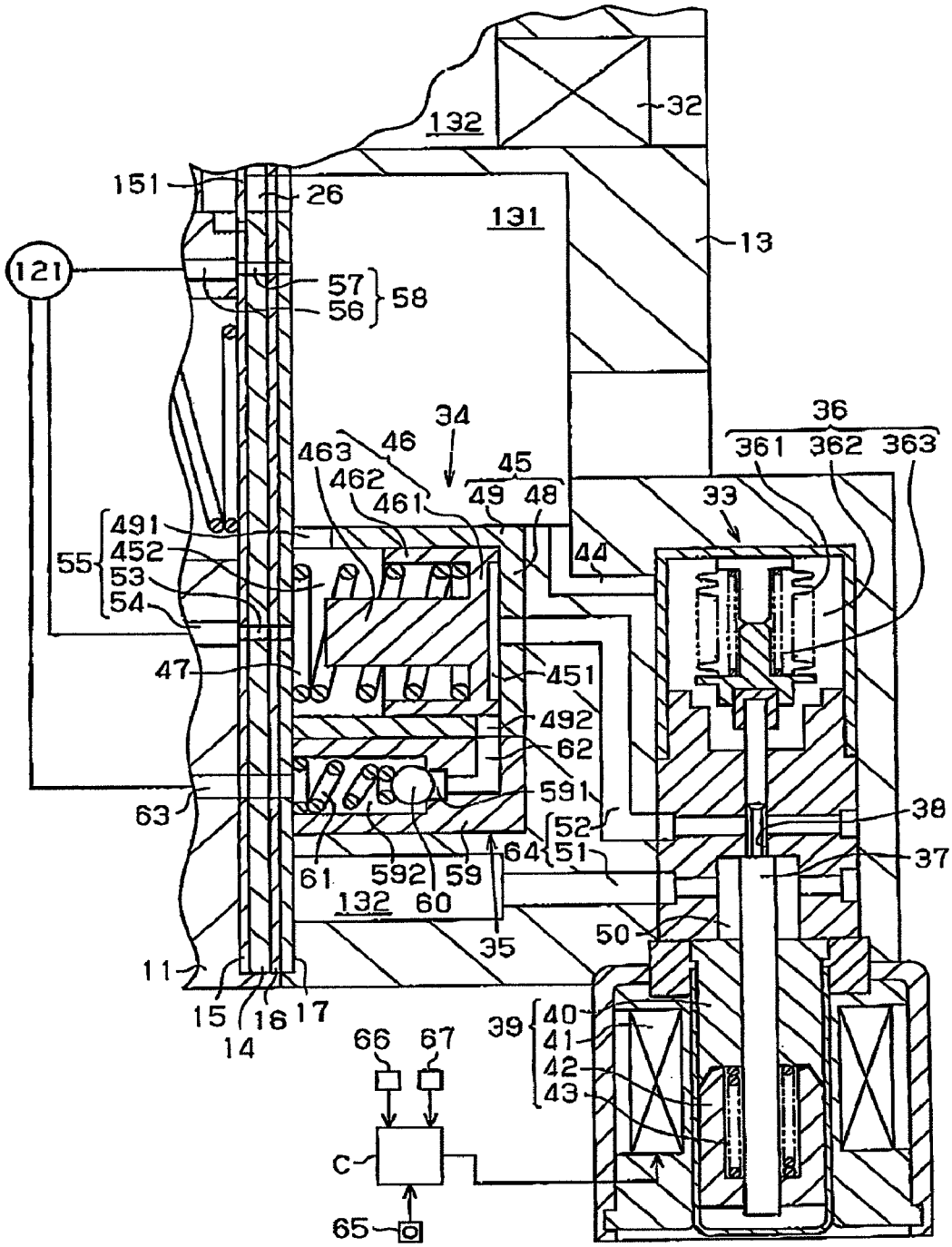
FIG. 3 is a longitudinal cross-sectional view similar to that of FIG. 2, but showing a different state of the variable displacement type compressor.

FIG. 3 shows the state in which with the air conditioning switch 65 turned on, supplying of electric current to the solenoid 39 is maximum (duty ratio=1) thereby to close the valve opening in the first control valve 33. Unless the variable displacement type compressor 10 operates under the minimum displacement (unless the inclination angle of the swash plate 22 is minimum), the stop device 32 is opened and the refrigerant circulates in the external refrigerant circuit 28.

When the valve opening of the first control valve 33 is zero (When the valve hole 38 is closed), no refrigerant gas in the discharge chamber 132 flows into the back pressure chamber 451 of the second control valve 34 through the supply passage 64. Accordingly, the valve body 46 of the second control valve 34 is positioned so as to open the second throttle passage 53 and also to close the communication hole 492 by the resultant force of the pressure (or suction pressure) in the second control valve chamber 452 in communication with the suction chamber 131 and the spring force of the valve spring 47. The check valve body 60 is positioned so as to close the check valve hole 591 by the spring force of the check valve spring 61.

In the state of FIG. 3, the supply passage 64 is closed and no refrigerant gas in the discharge chamber 132 flows into the pressure control chamber 121 through the supply passage 64. Also, since the second release passage 55 is opened, the refrigerant gas in the pressure control chamber 121 flows out to the suction chamber 131 through both the first release passage 58 and the second release passage 55. In this state, the inclination angle of the swash plate 22 is maximum and, therefore, the variable displacement type compressor 10 is operated under the maximum displacement.

When the air conditioning switch is turned on and the electric current supplied to the solenoid 39 of the first control valve 33 is neither 0 nor maximum (duty ratio being more than 0 but less than 1), refrigerant gas flows from the discharge chamber 132 to the back pressure chamber 451 of the second control valve 34. Accordingly, the valve body 46 of the second control valve 34 is positioned so as to close the second throttle passage 53 thereby to close the second release passage 55. Namely, refrigerant gas in the pressure control chamber 121 flows to the suction chamber 131 through the first release passage 58, and the refrigerant gas flowed from the discharge chamber 132 to the back pressure chamber 451 flows into the pressure control chamber 121 through the check valve 35. In this state, the inclination angle of the swash plate 22 becomes more than the minimum so that the suction pressure becomes the pressure set in accordance with the duty ratio, so that the variable displacement type compressor 10 is operated under the intermediate displacement.

When the first control valve 33 changes from the closed state shown in FIG. 3 to the opened state, the pressure in the discharge chamber 132 propagates to the back pressure chamber 451 thereby to change the valve body 46 of the second control valve 34 from the opened state shown in FIG. 3 to the closed state shown in FIG. 2. In this case, after the valve body 46 closes the second throttle passage 53, the check valve 35 opens. Thus, the relation between the timing of closing the second control valve 34 and the timing of opening the check valve 35 is set so that the check valve 35 is opened after the valve body 46 of the second control valve 34 is closed in response to the pressure change taking place in the back pressure chamber 451 when the first control valve 33 changes from the closed state to the opened state.

When the first control valve 33 changes from the opened state to the closed state shown in FIG. 3, the pressure in the back pressure chamber 451 decreases and the valve body 46 of the second control valve 34 is moved from the closed position shown in FIG. 2 to the opened position accordingly.

The following effects are obtained in the first preferred embodiment.

(1) When the valve body 46 of the second control valve 34 is in the closed position thereby to close the second release passage 55, the valve body 46 is urged by the resultant force of the pressure in the second control valve chamber 46 and the spring force of the valve spring 47 toward the position where the second release passage 55 is opened by the valve body 46. On the other hand, the valve body 46 is urged by the pressure in the back pressure chamber 451 (part of the supply passage 64) located downstream of the first control valve 33 toward the opposite position where the second release passage 55 is closed by the valve body 46. When the valve body 46 closes the second release passage 55, the pressure in the back pressure chamber 451 is substantially the same as the pressure in the pressure control chamber 121 because the pressure in the pressure control chamber 121 propagates through the fourth supply passage 63 into the back pressure chamber 451 located downstream of the first control valve 33 with a throttle function. On the other hand, since the second control valve chamber 452 communicates with the suction chamber 131 through the bleed hole 491, the pressure in the second control valve chamber 452 is substantially the same as the suction pressure. That is, in the compressor operation under an intermediate displacement, the differential pressure between the second control valve chamber 452 and the back pressure chamber 451 across the valve body 46 is substantially the same as the differential pressure between the suction pressure and the pressure in the pressure control chamber 121.

As compared with the case of the Japanese Patent Application Publication NO. 2002-21721, the differential pressure between the second control valve chamber 452 (suction pressure) and the back pressure chamber 451 (control pressure) is higher than that in the case of the above prior art [the differential pressure between the pressure in the back pressure chamber (corresponding to the control pressure) and the pressure in the cylindrical space (control pressure)]. The structure according to which the differential pressure between the second control valve chamber 452 and the back pressure chamber 451 can be increased over the prior art enables the spring force of the valve spring 47 to increase. Such increased spring force of the valve spring 47 permits the valve body 46 to move from the closed position to the opened position more reliably even if any foreign matters enter into a clearance between the peripheral wall 49 of the valve housing 45 and the sliding portion 462. This contributes to rapid release of refrigerant gas in the pressure control chamber 121 into the suction chamber 131 at a start-up of the compressor.

(2) Since the second release passage 55 is closed during the compressor operation under an intermediate displacement, the cross-sectional area of the second throttle passage 53 forming a part of the second release passage 55 can be made relatively larger in light of the operating efficiency. This also contributes to rapid release of refrigerant gas from the pressure control chamber 121 into the suction chamber 131 at a start-up of the compressor.

Since the first release passage 58 is always opened (is kept opened), refrigerant gas in the pressure control chamber 121 flows out to the suction chamber 131 through the first release passage 58 during the operation under an intermediate displacement. The cross-sectional area of the first throttle passage 57 forming a part of the first release passage 58 can be made as small as possible thereby to decrease the amount of refrigerant gas flowing from the pressure control chamber 121 to the suction chamber 131 within the range where smooth compressor operation under an intermediate displacement is achievable without affecting its operation efficiency. In other words, the amount of the refrigerant gas compressed in the discharge chamber 132 and returning to the suction chamber 131 through the pressure control chamber 121 can be reduced for improvement of the operating efficiency.

(3) When the first control valve 33 changes from the opened state to the closed state during the intermediate displacement operation under a high discharge pressure, the pressure in the pressure control chamber 121 may not decrease as desired due to the leakage of refrigerant gas from the cylinder bore 111 to the pressure control chamber 121. If the pressure which fails to decrease in the pressure control chamber 121 is propagated into the back pressure chamber 451 through the supply passage 64, the resultant force of the suction pressure in the second control valve chamber 452 and the spring force of the valve spring 47 may not exceed the pressure in the back pressure chamber 451 with the result that the valve body 46 of the second control valve 34 may fail to move from the closed position to the opened position.

The check valve 35 is provided to prevent the pressure failing to be decreased in the pressure control chamber 121 from being propagated into the back pressure chamber 451. Therefore, when the first control valve 33 changes from the opened state to the closed state, the valve body 46 of the second control chamber 34 moves from the closed position to the opened position more reliably.

(4) If the check valve 35 opens before the valve body 46 closes the second throttle passage 53, the pressure in the pressure control chamber 121 is propagated into the back pressure chamber 451 before the valve body 46 closes the second throttle passage 53, so that the pressure in the back pressure chamber 451 becomes substantially the same as the pressure in the pressure control chamber 121. As a result, the valve body 46 may be stopped on its way between the opened position and the closed position before reaching the closed position.

The check valve 35 is opened after the valve body 46 of the second control valve 34 has been moved to the closed position. Therefore, the pressure in the pressure control chamber 121 will not propagate into the back pressure chamber 451 and the pressure in back pressure chamber 451 remains the pressure of the discharge-pressure region of the compressor before the valve body 46 closes the second throttle passage 53. Thus, the valve body 46 is moved by the pressure of the discharge-pressure region in the back pressure chamber 451 to the position to close the second throttle passage 53.

Figure 4:
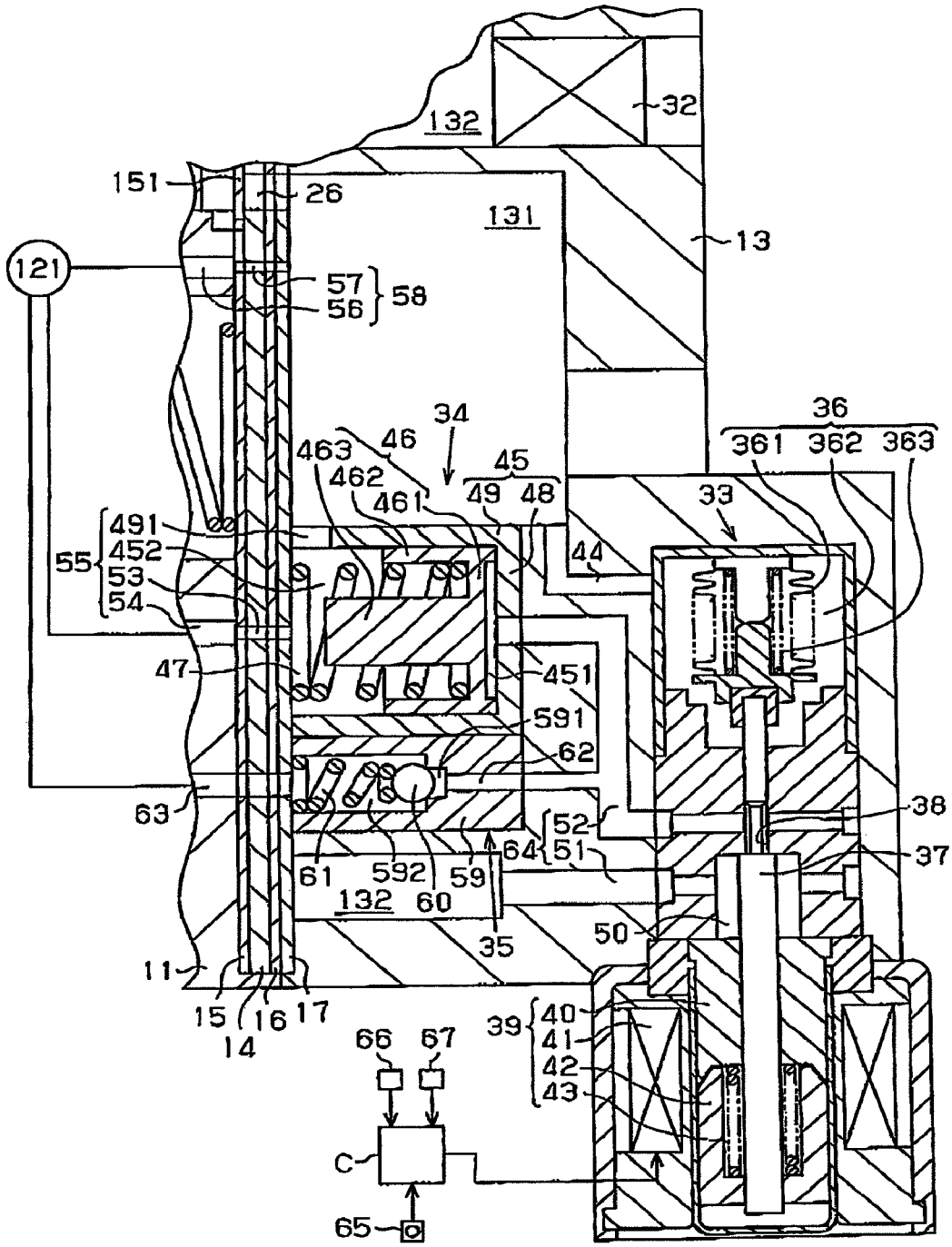
FIG. 4 is an enlarged fragmentary longitudinal cross-sectional view of a clutchless variable displacement type compressor according to an alternative embodiment of the present invention.

The present invention may be embodied in various ways as exemplified below. As shown in FIG. 4, the third supply passage 62 of the check valve 35 may be connected to the second supply passage 52 between the first control valve 33 and the second control valve 34. According to this embodiment, the same advantageous effects as those in the first preferred embodiment are obtained.

The check valve 35 in the first preferred embodiment may be dispensed with. In this case, the same advantageous effects as (1) and (2) in the first preferred embodiment (the advantageous effects (1) and (2) of the first preferred embodiment) are obtained. A control valve having a pressure sensing device and operable to adjust the opening degree of its valve body in accordance with the differential pressure between two different points in the discharge-pressure region of the compressor may be used as the first control valve 33. In other words, any control valve that is operable to increase the opening degree of its valve body with an increase of the refrigerant flow rate in the discharge-pressure region and to decrease the opening degree with a decrease of the refrigerant flow rate in the discharge-pressure region may be used as the first control valve 33.

The first control valve 33, the second control valve 34 and the check valve 35 may be arranged outside the housing of the variable displacement type compressor and these three valves may be arranged in communication with the suction chamber and the discharge chamber in the variable displacement type compressor through any suitable conduits.

The present invention may be applied to a variable displacement type compressor receiving power from an external drive source through a clutch. With the clutch engaged in such variable displacement type compressor, the refrigerant circulates In the external refrigerant circuit even during operation under the minimum displacement. With the clutch disengaged, the circulation of refrigerant in the external refrigerant circuit is stopped.

What is claimed is:

1. A variable displacement type compressor in which a discharge-pressure region, a suction-pressure region and a pressure control chamber are defined, a tiltable swash plate and a piston reciprocated by the swash plate being disposed in the pressure control chamber, and the inclination angle of the swash plate and the piston stroke being changed by adjustment of pressure in the pressure control chamber thereby to control the displacement of the compressor, the compressor comprising:

a supply passage for supplying refrigerant gas from the discharge-pressure region to the pressure control chamber;

a release passage for releasing the refrigerant gas from the pressure control chamber to the suction-pressure region, the release passage including a first release passage with a fixed throttle and a second release passage;

a first control valve for adjusting a cross-sectional area of the supply passage from the discharge-pressure region to the pressure control chamber; and a second control valve for adjusting cross-sectional area of the release passage in such a way as to open and close the second release passage, the second control valve including:

a valve body for opening and closing the release passage whose cross-sectional area is set minimum when the valve body is located at the closed position;

a valve spring for urging the valve body in a direction to open the release passage;

a back pressure chamber communicating with the supply passage downstream of the first control valve;

a second control valve chamber communicating with the second release passage; and a check valve in the supply passage between the first control valve and the pressure control chamber, the check valve allowing the refrigerant gas to flow only from the first control valve to the pressure control chamber, wherein the valve body separates the back pressure chamber and the second control valve chamber from each other, wherein, when the second control valve is closed, pressure in the supply passage downstream the first control valve acts on the valve body in a direction to close the release passage and pressure in the suction-pressure region acts on the valve body in a direction to open the release passage.

2. The variable displacement type compressor according to claim 1, the second control valve further comprising:

a valve housing having therein the valve body; and a bleed hole formed through the valve housing, wherein the valve body defines the back pressure chamber and the second control valve chamber In the valve housing, the second control valve chamber communicating with the suction-pressure region through the bleed hole.

3. The variable displacement type compressor according to claim 2, further comprising:

a retainer forming plate as a valve seat defining the second control valve chamber, the second release passage further having a throttle passage formed through the retainer forming plate, the valve body of the second control valve further having:

a contact portion contactable with the valve seat for opening and closing the throttle passage; and a sliding portion slidably fitted in the valve housing, wherein, when the contact portion is in contact with the retainer forming plate, the contact portion closes the throttle passage.

4. The variable displacement type compressor according to claim 1, wherein the check valve is opened after the valve body of the second control valve has been moved to the closed position.

5. The variable displacement type compressor according to claim 1, the second control valve further comprising:

a communication hole formed through the second control valve, wherein the communication hole forms a part of the supply passage, the first control valve communicating with the check valve through the second control valve and the check valve being provided in the supply passage between the second control valve and the pressure control chamber.

6. The variable displacement type compressor according to claim 1, wherein the check valve communicates with the supply passage between the first control valve and the second control valve.

* * * * *